US007699417B2

(12) United States Patent
Inoue

(10) Patent No.: US 7,699,417 B2
(45) Date of Patent: Apr. 20, 2010

(54) IMAGE RECORDING UNIT AND IMAGE RECORDING APPARATUS

(75) Inventor: Kyoichi Inoue, Akishima (JP)

(73) Assignee: Olympus Corporation, Tokyo (JP)

( * ) Notice: Subject to any disclaimer, the term of this patent is extended or adjusted under 35 U.S.C. 154(b) by 734 days.

(21) Appl. No.: 11/510,162

(22) Filed: Aug. 25, 2006

(65) Prior Publication Data

US 2007/0046758 A1 Mar. 1, 2007

(30) Foreign Application Priority Data

Aug. 30, 2005 (JP) ..... 2005-249669

(51) Int. Cl.

| | |
|---|---|
| ***B41J 25/308*** | (2006.01) |
| ***B41J 2/015*** | (2006.01) |
| ***B41J 2/15*** | (2006.01) |
| ***B41J 2/135*** | (2006.01) |
| ***B41J 2/14*** | (2006.01) |

(52) U.S. Cl. ..... 347/8; 347/20; 347/40; 347/44; 347/47

(58) Field of Classification Search ..... 101/480; 347/8, 16, 18, 104

See application file for complete search history.

(56) References Cited

U.S. PATENT DOCUMENTS 5,877,788 A * 3/1999 Haan et al. ..... 347/28
5,940,092 A * 8/1999 Kashimura et al. ..... 347/8
6,334,668 B1 * 1/2002 Isamoto ..... 347/57
2004/0179062 A1 * 9/2004 Rai et al. ..... 347/42

FOREIGN PATENT DOCUMENTS

| | | |
|---|---|---|
| JP | 7-81166 A | 3/1995 |
| JP | 2801283 B2 | 7/1998 |
| JP | 2002-67418 A | 3/2002 |

* cited by examiner

*Primary Examiner*—Matthew Luu
*Assistant Examiner*—Kendrick X Liu
(74) *Attorney, Agent, or Firm*—Frishauf, Holtz, Goodman & Chick, P.C.

(57) ABSTRACT

A recording unit according to the present invention includes a holding member, a recording element held on the holding member, an ink supply section held on the holding member, and a guiding portion provided in the holding member. The guiding portion guides a recording medium so as to prevent the recording medium from contacting the recording element. An image recording apparatus according to the present invention includes a conveying mechanism having a conveying member on which a recording medium is placed for conveyance, a recording unit, and a fixing member which fixes the recording unit. A guiding portion of the recording unit guides the recording medium to the conveying member so as to prevent the recording medium from contacting the recording element. The guiding portion also maintains a constant gap between the recording medium and the recording element to achieve high-quality image recording.

19 Claims, 7 Drawing Sheets

IMAGE RECORDING UNIT AND IMAGE RECORDING APPARATUS

CROSS-REFERENCE TO RELATED APPLICATIONS

This application is based upon and claims the benefit of priority from prior Japanese Patent Application No. 2005-249669, filed Aug. 30, 2005, the entire contents of which are incorporated herein by reference.

BACKGROUND OF THE INVENTION

1. Field of the Invention

The present invention relates to a recording unit and an image recording apparatus which spouts ink to record images.

2. Description of the Related Art

Recently prevailing image recording apparatuses, for example, ink jet printers, commonly have a conveying mechanism (belt platen or the like). The belt platen conveys recording medium, for example, ordinary paper or envelopes.

A recording medium conveyed by the belt platen may be wrinkled at its leading ends by moisture absorption or the like. If an image is recorded on the wrinkled recording medium, image quality may be degraded. The wrinkled recording medium may also contact a print head, which may cause an error in the conveyance of the recording medium.

Further, if the recording medium is curled (the recording medium partly floats), the gap between nozzles provided in the print head and the recording medium is nonuniform. The nonuniform gap may degrade the image quality. The curled part of the recording medium may also contact the print head, which may cause an error in the conveyance of the recording medium.

For example, Jpn. Pat. Appln. KOKAI Publication No. 2002-067418 discloses an image recording apparatus.

As shown in FIG. 12, this image recording apparatus is provided with a nozzle portion 42 having nozzles 41, an ink jet head 44 which is filled with ink 43, a conveying member 45 that conveys a recording medium 47, and a guide member 46 that prevents the recording medium 47 from floating.

Further, for example, Jpn. Pat. Appln. KOKAI Publication No. 07-081166 discloses an image recording apparatus.

As shown in FIG. 13, this image recording apparatus is provided with a print head 51 and a float preventing means 54 provided in front of the print head 51 in a moving direction and having an elastic member 52 and a surface film 53. The float preventing means 54 suppresses the floating (curl 56) of a recording medium 55.

Moreover, for example, Japanese Patent No. 2801283 discloses an ink jet recording apparatus having a carrier which holds a head and which is provided with a recording medium guide.

BRIEF SUMMARY OF THE INVENTION

A recording unit of the present invention includes a holding member, a recording element held on the holding member to spout ink onto a recording medium to record an image on the recording medium, an ink supply section held on the holding member to supply ink to the recording element, and a guiding portion provided in the holding member. The guiding portion is provided to guide, at a position located upstream of the recording element in a conveying direction of a recording medium, the recording medium to a conveying member on which the recording medium is placed for conveyance.

An image recording apparatus of the present invention includes a conveying mechanism having a conveying member on which a recording medium is placed for conveyance, a holding member, a recording element held on the holding member to spout ink onto the recording medium to record an image on the recording medium, an ink supply section held on the holding member to supply ink to the recording element, a guiding portion provided in the holding member, and a fixing member which fixes the holding member substantially perpendicularly to a conveying surface of the conveying member.

Advantages of the invention will be set forth in the description which follows, and in part will be obvious from the description, or may be learned by practice of the invention. Advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

With reference to the drawings, description will be given of a recording unit and an image recording apparatus according to the present invention.

Figure 1:
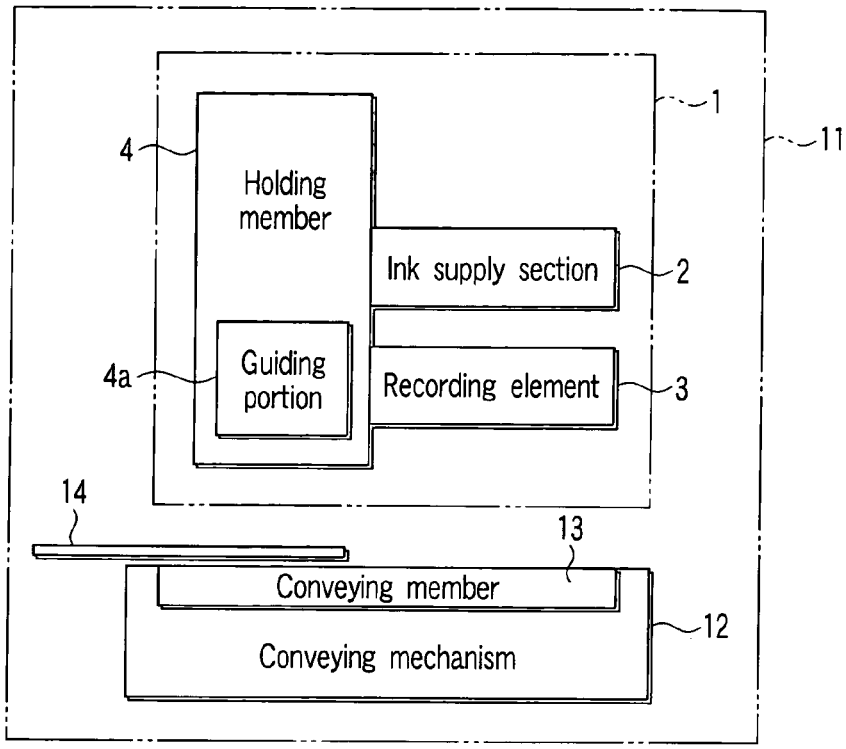
FIG. 1 is a conceptual block diagram of a recording unit and an image recording apparatus comprising the recording unit, according to the present invention.

FIG. 1 is a conceptual block diagram of a recording unit and an image recording apparatus comprising the recording unit, according to the present invention.

In the description below, a direction in which a recording medium 14 is conveyed in the figure is defined as an X axis direction. A direction orthogonal to the conveying direction is defined as a Y axis direction or the width direction of the recording medium 14. A direction orthogonal to an XY plane is defined as a Z axis direction or a vertical direction.

An image recording apparatus 11 shown in FIG. 1 comprises at least a conveying mechanism 12 having a conveying member 13 on which the recording medium 14 is placed for conveyance, and a recording unit 1. A control section (not shown) controls an operation in which a conveying mechanism 12 conveys the recording medium 14 and an operation in which the recording unit 1 record an image on the recording medium 14.

The recording unit 1 is provided with a recording element 3 that records an image on the recording medium 14, an ink supply section 2 that supplies ink to the recording element 3, and a holding member 4 that holds at least the ink supply section 2 and the recording element 3. The holding member 4 has a guiding portion 4*a*.

Figure 2:
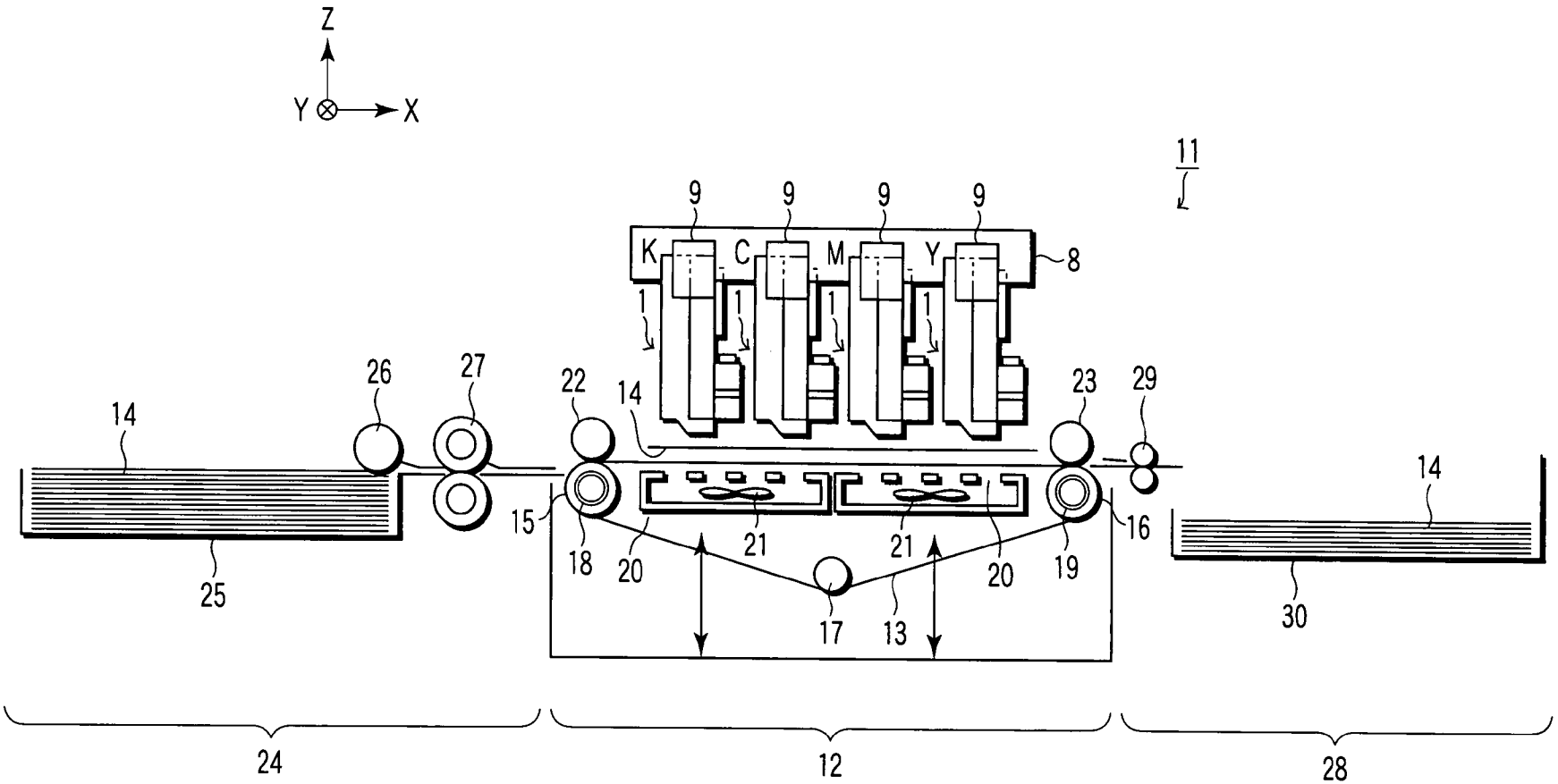
FIG. 2 is a side view showing the exemplary configuration of the recording unit and the image recording apparatus comprising the recording unit, according to the present invention.

Now, with reference to FIG. 2, description will be given of an example of configuration of the recording unit and the image recording apparatus comprising the recording unit, according to the present invention.

A feeding system 24 is provided with a feeding tray 25 in which a plurality of recording medium 14 are stored, a pickup roller 26 that picks up and conveys each stored recording medium 14, and a pair of registration rollers 27 that rectifies skewing of the conveyed recording medium 14. Once the recording medium 14 touches the pair of registration rollers 27, its skewing is rectified. The pair of registration rollers 27 subsequently holds the recording medium 14 tight and conveys it to the conveying mechanism 12.

The conveying mechanism 12 is provided with, for example, three platen rollers 15, 16, and 17 disposed from upstream to downstream in the conveying direction of the recording medium 14 and substantially parallel to one another. For example, an endless belt in the conveying member 13 is rotationally movably passed around the platen rollers 15, 16, and 17. A plurality of holes 13*a* (see FIG. 8) are formed in the endless belt. For example, a rotary encoder 18 is connected to a rotating shaft of the platen roller 15. The rotary encoder 18 generates conveying distance information on the recording medium 14. For example, a driving motor 19 is connected to a rotating shaft of the platen roller 16. The driving motor 19 rotates the platen roller 16 to rotationally move the endless belt. A touching roller 22 is provided above the platen roller 15 so as to be opposed to the platen roller 15 through the endless belt. A touching roller 23 is provided above the platen roller 16 so as to be opposed to the platen roller 15 through the endless belt.

The touching rollers 22 and 23 prevent the recording medium 14 from floating.

A plurality of suction chambers 20 are provided inside the endless belt passed around the platen rollers 15, 16, and 17. Each of the suction chambers 20 has a suction fan 21 that sucks the conveyed recording medium 14 onto the endless belt via a plurality of holes 13*a*.

The recording unit 1 are positioned and fixed to a fixing member 8 via a coupling member 9 (this will be described later in detail).

In the exemplary configuration of the image recording apparatus 11 shown in the figure, the recording unit 1 that spout color inks K (black), C (cyan), M (magenta), and Y (yellow) are disposed in this order from upstream to downstream in the conveying direction of the recording medium 14 at prescribed intervals.

The recording unit 1 fixed to the fixing member 8 oppose the recording elements 3 held on the holding members 4, to the conveying member 13 of the conveying mechanism 12 (this will be described later in detail).

The recording element 3 has a nozzle forming surface 3*a* which is opposed to the conveying member 13 and in which a plurality of nozzles are formed. The recording element 3 has a nozzle row of a plurality of nozzles which are formed in its nozzle forming surface 3*a* in a Y axis direction and through which ink is spouted.

A storing system 28 is provided with a pair of storing rollers 29 that conveys the recording medium 14 downstream on which an image has been recorded, and a storing tray 30 that stores the conveyed recording medium 14 on which an image has been recorded.

The fixing member 8 may be provided on, for example, a carriage opposed to the conveying mechanism 12 or an additional member corresponding to the fixing member 8 may be integrally formed on the carriage.

Now, a first embodiment of the recording unit according to the present invention will be described with reference to FIGS. 3A, 3B, and 3C.

Figure 3A:
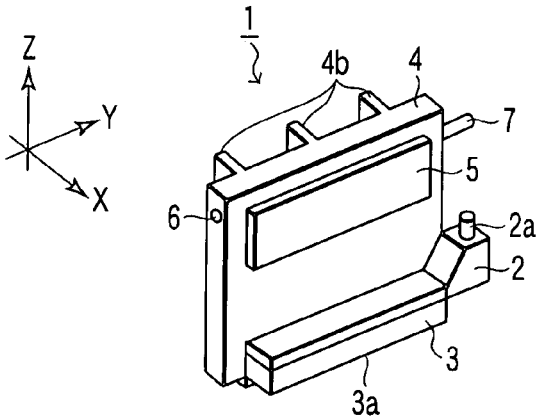
FIG. 3A is a perspective view of a first embodiment of the recording unit according to the present invention, and is specifically a perspective view of the recording unit as viewed from an ink supply section, a recording element, and a recording element drive section.

FIG. 3A is a perspective view of the first embodiment of the recording unit according to the present invention, and is specifically a perspective view of the recording unit as viewed from the ink supply section, the recording element, and a recording element drive section.

Figure 3B:
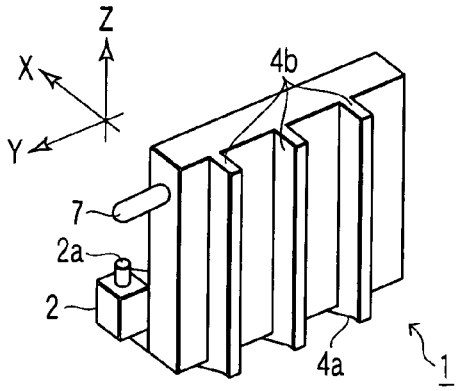
FIG. 3B is a perspective view of the first embodiment of the recording unit according to the present invention, and is specifically a perspective view of the recording unit as viewed from a guiding portion and a heat radiation fin.

FIG. 3B is a perspective view of the first embodiment of the recording unit according to the present invention, and is specifically a perspective view of the recording unit as viewed from the guiding portion and a heat radiation fin.

Figure 3C:
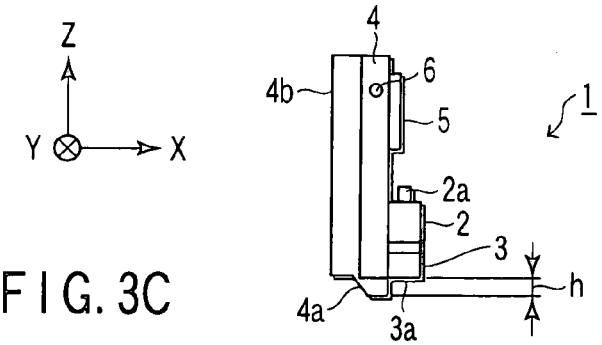
FIG. 3C is a side view of the first embodiment of the recording unit according to the present invention.

FIG. 3C is a side view of the first embodiment of the recording unit according to the present invention.

As shown in FIG. 3A, the holding member 4 holds the recording element 3, the ink supply section 2, and a recording element drive section 5 on its vertical surface located downstream in the conveying direction of the recording medium 14; the recording element 3 has the nozzle forming surface 3*a*, the ink supply section 2 supplies ink to the recording element 3, and the recording element drive section 5 drives the recording element 3. The ink supply section 2 is provided with an ink supply port 2*a* through which ink from an ink tank (not shown) is supplied to the ink supply section 2.

The recording element 3 is provided with, for example, a piezoelectric element (PZT) and an ink chamber (neither of them are shown).

When the piezoelectric element (PZT) varies the ink chamber, the recording element 3 spouts ink through the nozzles, formed in the nozzle forming surface 3*a*.

A drive IC and the like are mounted in the recording element drive section 5. The drive IC controls the piezoelectric element (PZT).

The ink supply section 2 is provided, for example, immediately above the recording element 3. The ink supply section 2 supplies ink to the recording element 3 by gravitational drop.

The recording element 3 and the recording element drive section 5 are connected together, for example, by wire bonding or via a flexible cable.

The recording element drive section 5 is preferably held above the ink supply port 2*a* in order to avoid attaching ink to the recording element drive section 5.

The recording element 3 is not limited to the piezoelectric element (PZT) but may spout ink utilizing, for example, thermal energy generated by a heating element.

With this scheme, the holding member 4 need not necessarily hold the recording element drive section 5.

This is because heat generated by the recording element drive section 5 applied to this scheme is less than that generated by the recording element drive section 5 applied to the piezoelectric element (PZT) scheme.

As shown in FIG. 3B, the holding member 4 has the heat radiation fins 4*b* formed on its vertical surface located upstream in the conveying direction of the recording medium 14; the heat radiation fins 4*b* are, for example, integrally formed on the holding member 4. The heat radiation fans 4*b* radiate heat generated by the recording element 3 and recording element drive section 5, via the holding member 4.

The heat radiation fins 4*b* may be separate from the holding member 4.

The heat radiation fins 4*b* may be omitted if for example, heat generated by the recording element 3 and recording element drive section 5 is sufficiently radiated by heat transmission to the holding member 4.

As shown in FIG. 3C, the holding member 4 is also provided with guiding portions 4*a* extending from the vertical surface of the holding member 4 which is located upstream in the conveying direction of the recording medium 14 or from a position located upstream of the vertical surface. The guiding portions 4*a* extend substantially parallel to an X axis direction and in proximity to the conveying member 13.

A lower end of each of the guide portions 4*a* extends a distance h downward from the nozzle forming surface 3*a* of the recording element 3. The guiding portions 4*a* guide the recording medium 14 placed on and conveyed by the conveying member 13 so that the recording medium 14 does not contact the nozzle forming surface 3*a*.

The guiding portions 4*a* are formed integrally with or separately from the holding member 4.

As shown in FIG. 3A, the holding member 4 of the recording unit 1 is provided with positioning sections 6 and 7 which position the recording unit 1 on, for example, the fixing member 8.

In the illustrated embodiment, the positioning section 6 comprises, for example, a positioning hole formed in the holding member 4. The positioning position 7 comprises, for example, a positioning pin jutting from the holding member 4.

The positioning sections 6 and 7, provided on the holding member 4, are positioned on a positioning section provided on the fixing member 8 (this will be described later in detail).

The first embodiment of the recording unit according to the present invention, the guiding portions 4*a* guide the conveyed recording medium 14 to the conveying member 13. This prevents the recording medium 14 from contacting the nozzle forming surface 3*a* of the recording element 3.

In the first embodiment of the recording unit according to the present invention, the heat radiation fins 4*b* and the holding member 4 are integrated together. Thus, in the first embodiment, heat generated by the recording element 3, recording element drive section 5, or the like can be radiated via the holding member 4.

Further, in the first embodiment of the recording unit according to the present invention, the ink supply section 2 is placed immediately above the recording element 3. The first embodiment can thus supply ink to the recording element 3 by gravitational drop.

Furthermore, in the first embodiment of the recording unit according to the present invention, the holding member 4 has the guiding portions 4*a* and heat radiation fins 4*b* provided on one of its vertical surfaces. The holding member 4 holds the recording element drive section 5, ink supply section 2, and recording element 3 on the other vertical surface in this order from top to bottom. Thus, in the first embodiment, the recording unit 1 is slim and compact in the conveying direction of the recording medium 14.

Moreover, in the first embodiment of the recording unit according to the present invention, the positioning sections 6 and 7 are provided on the holding member 4 to position the recording unit 1. The first embodiment can thus easily position the recording unit 1 when installing it in, for example, the image recording apparatus 11.

Figure 4:
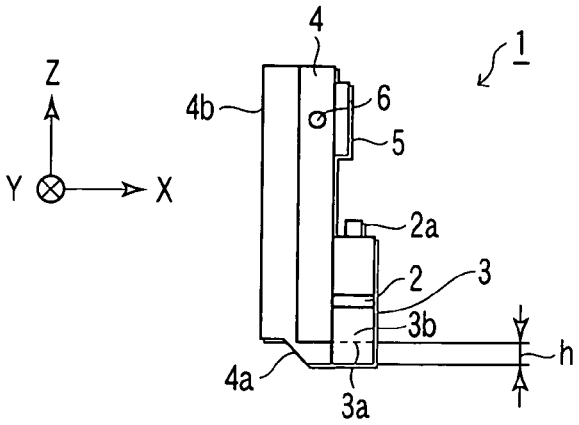
FIG. 4 is a side view of a first variation of the first embodiment of the recording unit according to the present invention.

Now, with reference to FIG. 4, description will be given of a first variation of the first embodiment of the recording unit according to the present invention.

In the description of the first variation, components equivalent to those of the first embodiment are denoted by the same reference numerals with their detailed description omitted.

The first variation differs from the first embodiment in that a recording element support member 3*b*is provided to at least internally support the nozzle forming surface 3*a* of the recording element 3.

The recording element support member 3*b* supports the nozzle forming surface 3*a* above a lower tip of each of the guiding portions 4*a*.

The recording medium 14 guided to the conveying member 13 by the guiding portions 4*a* is further guided to the conveying member 13 by a lower end of the recording member support member 3*b*.

Thus, in the first variation of the first embodiment of the recording unit according to the present invention, the recording medium 14 is guided to the conveying member 13 by the guiding portions 4*a* and further to the conveying member 13 by the lower end of the recording element support member 3*b*. The first variation can thus prevent the recording medium 14 from contacting the nozzle forming surface 3*a*.

Figure 5:
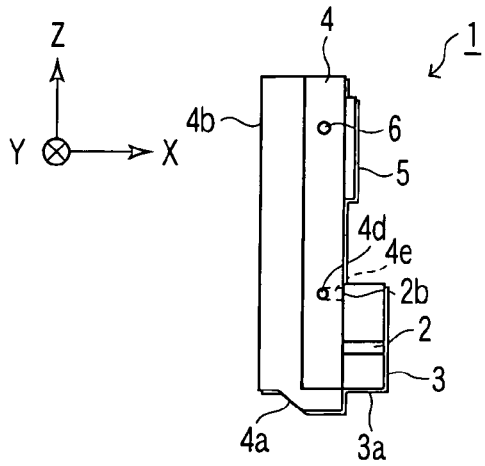
FIG. 5 is a side view of a second variation of the first embodiment of the recording unit according to the present invention.

Now, with reference to FIG. 5, description will be given of a second variation of the first embodiment of the recording unit according to the present invention.

In the description of the second variation, components equivalent to those of the first embodiment are denoted by the same reference numerals with their detailed description omitted.

The second variation differs from the first embodiment in that the ink supply section 2 has the ink supply port formed in its side that is closer to the holding member 4.

To supply ink to the ink supply section 2, the holding member 4 in the second variation is provided with at least one ink path 4*e* formed in the holding member 4 and an ink supply port 4*d* that is in communication with the ink path 4*e*.

The ink supply section 2 has an ink supply port 2*b* formed in its side held by the holding member 4; the ink supply port 2*b* is in communication with the ink path 4*e*.

The supply of ink from the ink supply port 4*d* to the ink supply section 2 is thus achieved by using the holding member 4 to hold the side of the ink supply section 2 to connect the ink path 4*e* and the ink supply port 2*b* together. The second variation can thus safely supply ink to the ink supply section 2 through the shortest path.

Now, with reference to FIGS. 6 and 7, description will be given of a second embodiment of the recording unit according to the present invention.

In the description of the second embodiment, components equivalent to those of the first embodiment are denoted by the same reference numerals with their detailed description omitted.

The second embodiment differs from the first embodiment in that a plurality of recording elements 3 and a plurality of ink supply sections 2 are provided at least on the holding member 4.

Recording elements 3-1 to 3-4 in the second embodiment are each provided with the nozzle forming surface 3*a* as is the case with the first embodiment. The nozzle forming surface 3*a*, formed on each of the recording elements 3-1 to 3-4, has a nozzle row extending linearly in the Y axis direction.

In the second embodiment of the recording unit 1 according to the present invention, the recording elements 3-1 to 3-4 are disposed so that a plurality of nozzles in the nozzle row, formed in the nozzle forming surface 3*a* of each of the recording elements 3-1 to 3-4, extend over a length equal to or larger than the width of the recording medium 14. The second embodiment of the recording unit 1 according to the present invention thus records 1 to n (n is an integer where 2≦n) lines of image data on the recording medium 14.

Figure 6:
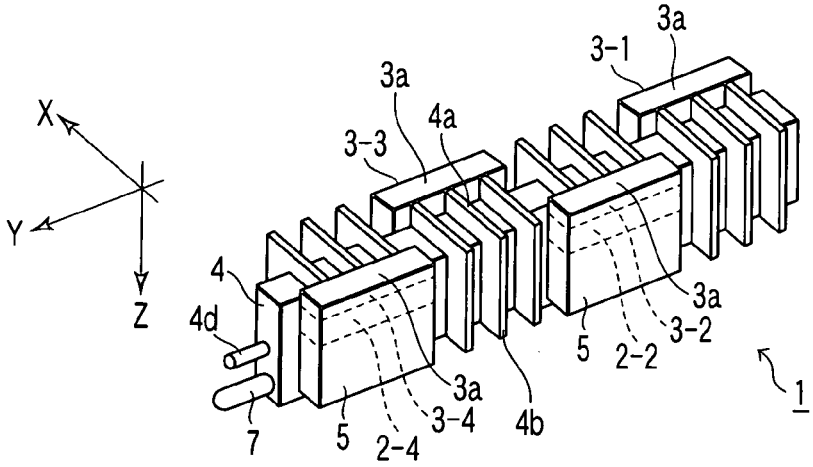
FIG. 6 is a perspective view of a second embodiment of the recording unit according to the present invention, and is specifically a perspective view of the inverted recording unit.
Figure 7:
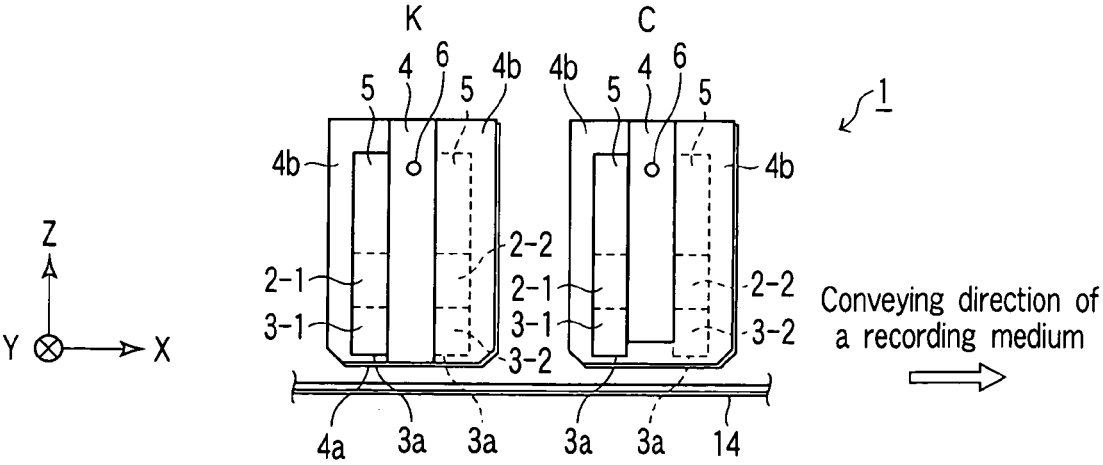
FIG. 7 is a side view of the second embodiment of the recording unit according to the present invention.

In the exemplary configuration of second embodiment of the recording unit 1 shown in FIG. 6, n =4 for the plurality of recording elements 3-1 to 3-n and the plurality of ink supply sections 2-1 to 2-n (n is an integer where 2≦n). However, the second embodiment is not limited to this but is applicable to the case in which n is any other integer that is at least 2.

The holding member 4 in the second embodiment holds each of the recording members 3-1 to 3-4 and ink supply sections 2-1 to 2-4 on either of its vertical surfaces; the recording members 3-1 to 3-4 and ink supply sections 2-1 to 2-4 are alternately arranged in the conveying direction of the recording medium 14 (X axis direction).

As is the case with the second variation of the first embodiment, to supply ink to the ink supply sections 2-1 to 2-4, the holding member 4 in the second embodiment has at least one internal ink path 4*e* and an ink supply port 4*d* that is in communication with the ink path 4*e*.

Each of the ink supply ports 2-1 to 2-4 has the ink supply port 2*b* formed in its side held by the holding member 4 and which is in communication with the ink path 4*e*.

The supply of ink from the ink supply port 4*d* to the ink supply sections 2-1 to 2-4 is thus achieved by using the holding member 4 to hold the sides of the ink supply sections 2-1 to 2-4 to connect the ink path 4*e* and the ink supply port 2*b* together. The second embodiment can thus safely supply ink to the ink supply sections 2-1 to 2-4 through the shortest path.

The holding member 4 in the second embodiment has the heat radiation fins 4*b* integrally formed on its other vertical surface. The guiding portions 4*a* are formed integrally with or separately from the holding member 4.

The holding member 4 in the second embodiment is also provided with the positioning sections 6 and 7 that position the recording unit 1. In the second embodiment, the positioning section 6 comprises, for example, a positioning hole formed in the holding member 4. The positioning position 7 comprises, for example, a positioning pin jutting from the holding member 4.

The positioning sections 6 and 7, provided on the holding member 4, are positioned on a positioning section provided on the fixing member 8 (this will be described later in detail).

In the second embodiment of the recording unit according to the present invention, the guiding portions 4*a* guide the conveyed recording medium 14 to the conveying member 13 even if the recording unit 1 has, for example, the plurality of recording elements 3-1 to 3-4 and the plurality of ink supply sections 2-1 to 2-4. The second embodiment can thus prevent the recording medium 14 from contacting the nozzle forming surface 3*a*.

In the second embodiment of the recording unit according to the present invention, the heat radiation fins 4*b* are integrated with the holding member 4. Thus, in the second embodiment, heat generated by the recording elements 3-1 to 3-4, recording element drive section 5, or the like during image recording can be radiated via the holding member 4.

Further, in the second embodiment of the recording unit according to the present invention, the plurality of ink supply sections 2-1 to 2-4 are arranged immediately above the plurality of recording elements 3-1 to 3-4. The second embodiment can thus supply ink to the recording elements 3-1 to 3-4 by gravitational drop.

Furthermore, in the second embodiment of the recording unit according to the present invention, the holding member 4 has the guiding portions 4*a* and heat radiation fins 4*b* provided on one of its vertical surfaces. The holding member 4 holds the recording element drive section 5, ink supply sections 2-1 to 2-4, and recording elements 3-1 to 3-4 on the other vertical surface in this order from top to bottom. Thus, in the second embodiment, the recording unit 1 is slim and compact in the conveying direction of the recording medium 14.

The second embodiment of the recording unit according to the present invention can also safely supply ink to the ink supply sections 2-1 to 2-4 through the shortest path.

Moreover, in the second embodiment of the recording unit according to the present invention, the positioning sections 6 and 7 are provided on the holding member 4 to position the recording unit 1. The second embodiment can thus easily position the recording unit 1 when installing it in, for example, the image recording apparatus 11.

Now, with reference to FIGS. 8 and 9, description will be given of a first embodiment of an image recording apparatus according to the present invention.

In the description of the first embodiment of the image recording apparatus according to the present invention, components equivalent to those of the first embodiment of the recording unit according to the present invention are denoted by the same reference numerals with their detailed description omitted.

Figure 8:
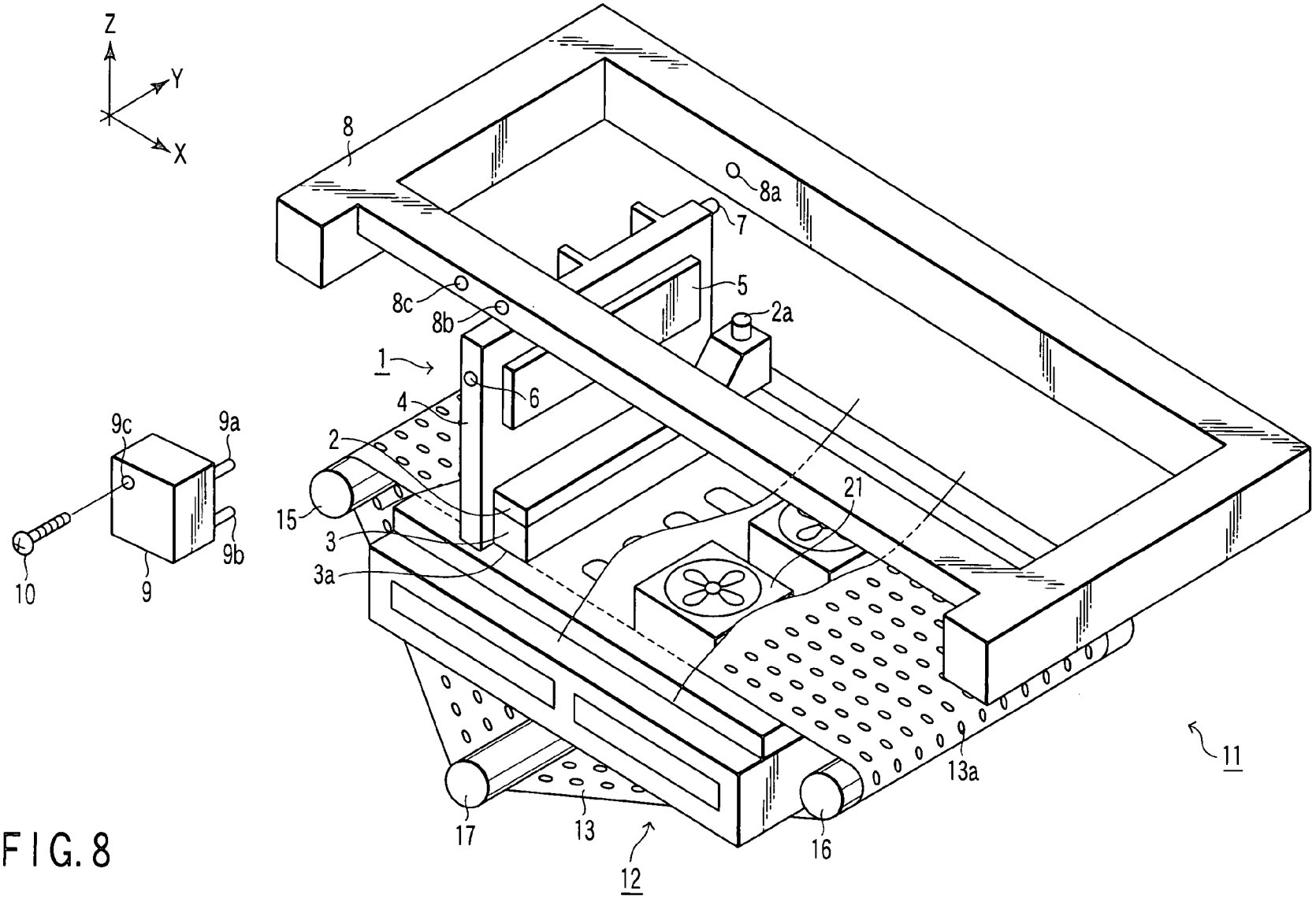
FIG. 8 is a perspective view illustrating a first embodiment of an image recording apparatus according to the present invention.
Figure 9:
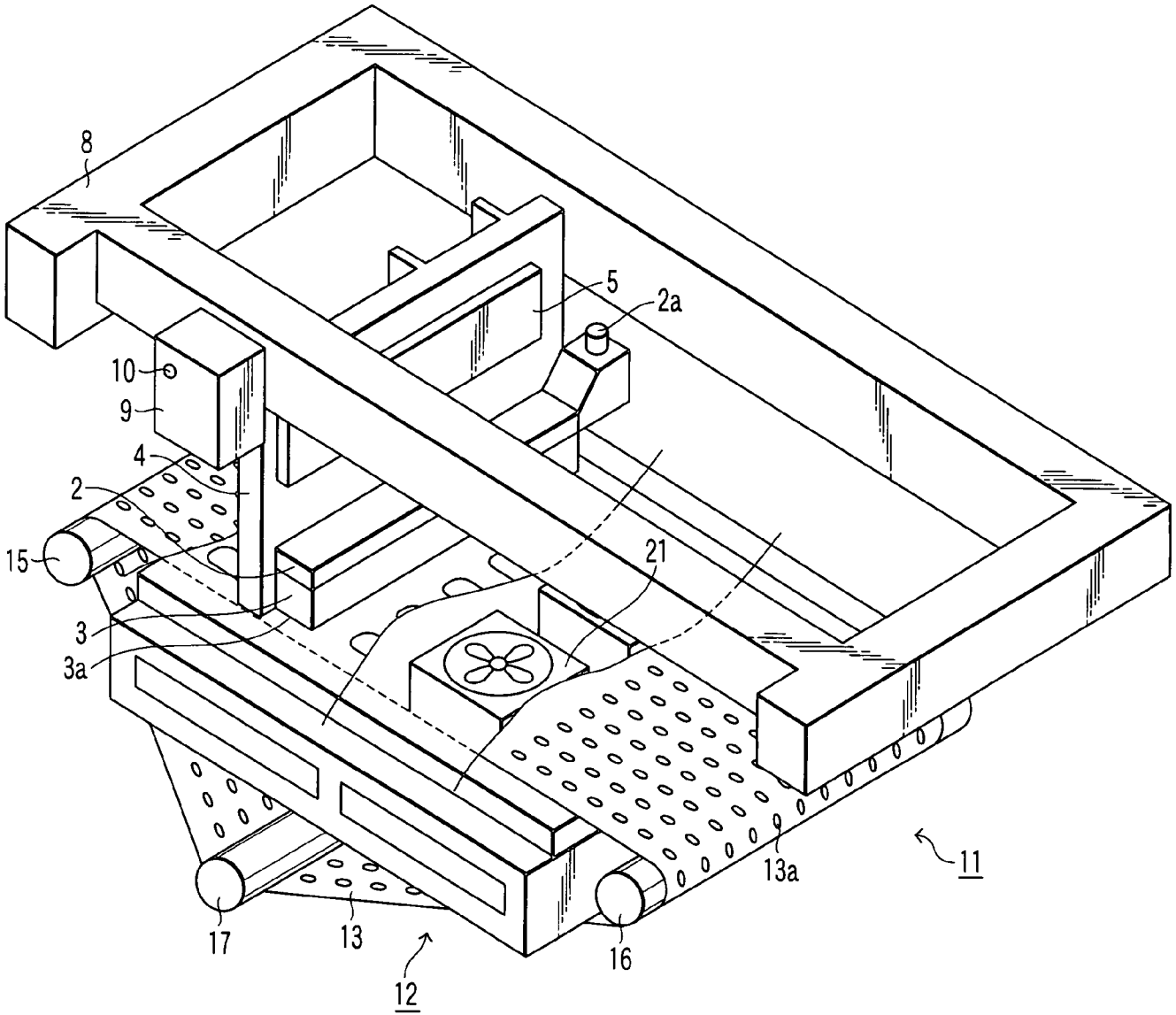
FIG. 9 is a perspective view illustrating the first embodiment of the image recording apparatus according to the present invention.
Figure 9:
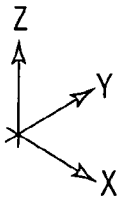

As shown in FIG. 8, the first embodiment of the image recording apparatus 11 according to the present invention comprises at least the recording unit 1 according to the present invention, the fixing member 8 that positions and holds the recording unit 1 so that the recording unit 1 hangs down, the coupling member 9 that positions and holds the recording unit 1 on the fixing member 8, and the conveying mechanism 12 opposed to the nozzle forming surface 3*a* of the recording unit 3 of the recording unit 1.

The fixing member 8 in the first embodiment of the image recording apparatus 11 has at least positioning sections 8*a*, 8*b*, and 8*c* which position the recording unit 1.

The coupling member 9 in the first embodiment of the image recording apparatus 11 has at least positioning members 9*a*, 9*b*, and 9*c* which positions, couples, and holds the recording unit 1 on the fixing member 8, and a screw 10 which fixes the coupling member 9 to the fixing member 8.

In the configuration of the first embodiment of the image recording apparatus 11, as shown in FIG. 8, the positioning section 7 of the holding member 4 comprises, for example, a pin jutting from the holding member 4. The positioning section 6 of the holding member 4 comprises, for example, a hole formed in the holding member 4.

In the configuration of the first embodiment of the image recording apparatus 11, the positioning sections 8*a* and 8*b* of the fixing member 8 comprise, for example, holes formed in the fixing member 8. The positioning section 8*c* of the fixing member 8 comprises, for example, a thread in which the screw 10 is threadably fitted.

In the configuration of the first embodiment of the image recording apparatus 11, the positioning sections 9*a* and 9*b* of the coupling member 9 comprise, for example, pins provided on an upper and lower part of the coupling member 9 so as to jut linearly from the coupling member 9. The positioning section 9*c* of the coupling member 9 comprises, for example, a hole penetrating the coupling member 9. The screw 10 is inserted into the coupling member 9 to fix the coupling member 9 to the fixing member 8.

Now, a detailed description will be given of how the recording unit 1 is coupled to and held on the fixing member 8 via the coupling member 9 after being positioned on the fixing member 8, in the configuration of the first embodiment of the image recording apparatus 11.

The jutting pin constituting the positioning section 7 of the recording unit 1 is fitted into the hole constituting the positioning section 8*a*of the fixing member 8.

The coupling member 9 fits the jutting pin constituting the positioning section 9*a* of the coupling member 9 into the positioning section 8*b* of the fixing member 8. The coupling member 9 also fits the jutting pin constituting the positioning section 9*b* into the hole constituting the positioning section 6 of the recording unit 1.

The screw 10 inserted into the penetrating hole constituting the positioning section 9*c* of the coupling member 9 is threadably fitted in the thread constituting the positioning section 8*c* of the fixing member 8. The recording unit 1 is thus positioned and held on the fixing member 8.

The first embodiment of the image recording apparatus 11 thus positions and holds the nozzle forming surface 3*a* of the recording element 3 of the recording unit 1 above the conveying member 13 of the conveying mechanism 12 via a prescribed gap. This provides an image recording apparatus that can record high-quality images.

Even if for example, a curl or wrinkle occurs in the recording medium 14 placed on the conveying member 13 of the conveying mechanism 12 and conveyed below the nozzle forming surface 3*a* , the first embodiment of the image recording apparatus 11 can prevent the recording medium 14 from contacting the nozzle forming surface 3*a*. This avoids damaging the plurality of nozzles in the recording element 3.

In the first embodiment of the image recording apparatus 11, the recording unit 1 is mounted on and removed from the fixing member 8 by simple installation of the coupling member 9. This enables a reduction in apparatus manufacture costs and an improvement in maintainability.

Figure 10:
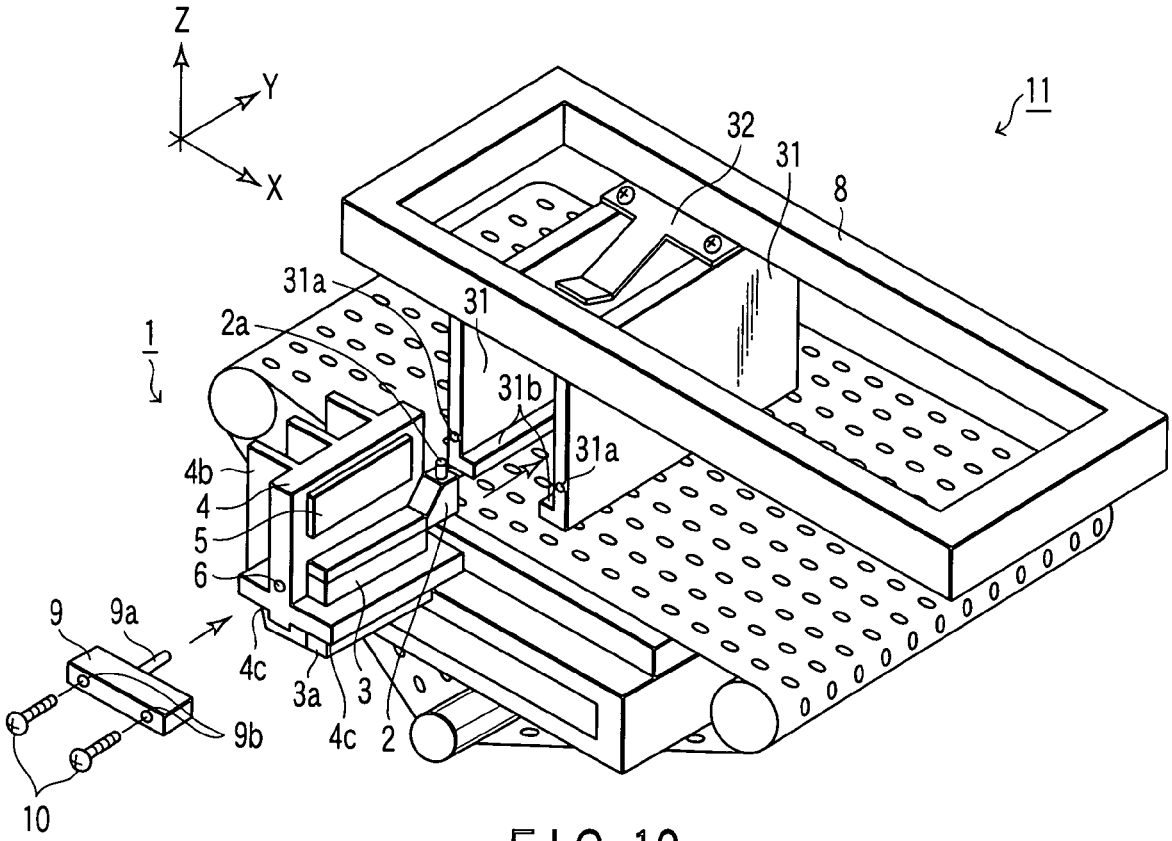
FIG. 10 is a perspective view illustrating a second embodiment of the image recording apparatus according to the present invention.
Figure 11:
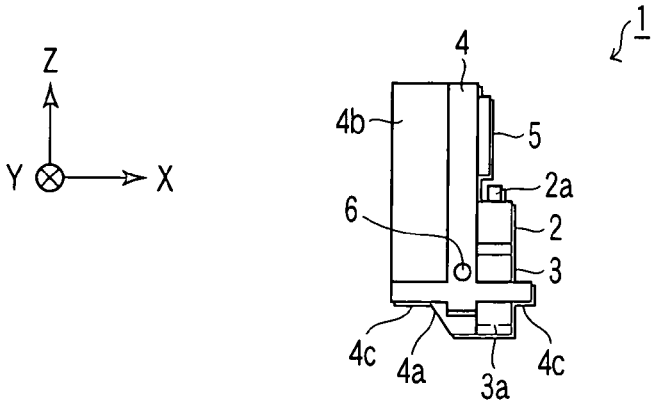
FIG. 11 is a side view of the recording unit in the second embodiment of the image recording apparatus according to the present invention.
Figure 12:
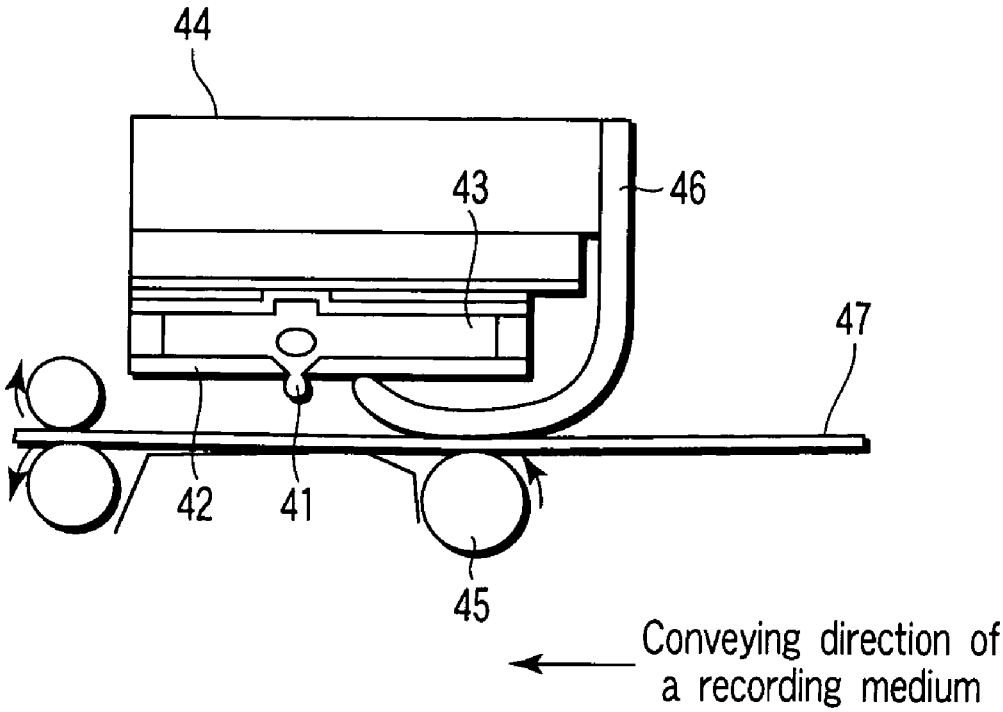
FIG. 12 (PRIOR ART)
FIG. 12 is a schematic diagram of an image recording section of a conventional image recording apparatus.
Figure 13:
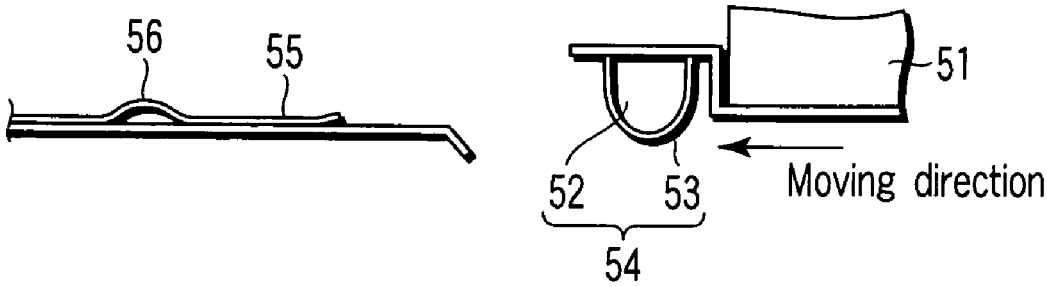
FIG. 13 (PRIOR ART)
FIG. 13 is a schematic diagram of the image recording section of the conventional image recording apparatus.

With reference to FIGS. 10 and 11, description will be given of the second embodiment of the image recording apparatus according to the present invention.

In the description of the second embodiment of the image recording apparatus according to the present invention, components equivalent to those of the first embodiment of the recording unit according to the present invention are denoted by the same reference numerals with their detailed description omitted.

As shown in FIG. 10, the second embodiment of the image recording apparatus 11 according to the present invention comprises at least the recording unit 1 according to the present invention, the fixing member 8, supporting members 31 which hang down from the fixing member 8 to position and support the recording unit 1, an elastic member 32 provided at upper ends of the supporting members 31 to press the recording unit 1 toward base levels 31*b* of the supporting members 31 so that the recording unit 1 touches the base levels 31*b*, the coupling member 9 that positions and holds the recording unit 1 in the supporting member 31, and the conveying mechanism 12 opposed to the nozzle forming surface 3*a* of the recording element 3 of the recording unit 1.

Each of the supporting members 31 in the second embodiment of the image recording apparatus 11 is composed of, for example, a pair of substantially L letterform members. Base levels 4*c* of the recording unit 1 are supported by the pair of L letterform members constituting the base levels 31*b* of the supporting members 31.

The elastic member 32, provided at the upper ends of the supporting members 31, is composed of, for example, a leaf spring. The upper end of the holding member 4 of the recording unit 1 is pressed downward so that the base levels 4*c* of the holding member 4 of the recording unit 1 touches the base levels 31*b* of the supporting members 31, which comprise the pair of L letterform members.

The pair of L letterform members constituting the supporting members 31 has a pair of positioning sections 31*a* which positions the recording unit 1.

The coupling member 9 in the second embodiment of the image recording apparatus 11 has at least the positioning sections 9*a* and 9*b* which position the recording unit 1 in the pair of L letterform members constituting the supporting members 31, and the screws 10 that fix the recording unit 1 to the pair of L letterform members constituting the supporting members 31 after the recording unit 1 has been positioned in the supporting members 31.

In the configuration of the second embodiment of the image recording apparatus 11, as shown in FIG. 10, the positioning section 6 of the holding member 4 of the recording unit 1 comprises, for example, a hole formed in the holding member 4. The positioning section 9*a* of the coupling member 9 comprises, for example, a pin jutting from the coupling member 9. The positioning sections 9*b* of the coupling member 9 comprise, for example, a pair of holes. The pair of L letterform members constituting the positioning sections 31*a*of the supporting members 31 comprises, for example, threads in which the pair of screws 10, penetrating the positioning sections 9*b* of the coupling member 9, is threadably fitted.

Now, a detailed description will be given of how the recording unit 1 is coupled to and held on the fixing member 8 via the coupling member 9 after being positioned on the fixing member 8, in the second embodiment of the image recording apparatus 11.

The recording unit 1 moves the base levels 4*c* formed on the holding member 4 of the recording unit 1 in the Y axis direction while slidingly contacting the base levels 4*c* with the base levels 31*b* of the supporting members, which comprise the pair of L letterform members. On this occasion, an upper end of the holding member 4 of the recording unit 1 is pressed downward by the elastic member 32, provided at the upper end of the pair of L letterform members constituting the supporting members 31.

The coupling member 9 fits the jutting pin constituting the positioning section 9*a* into the hole constituting the position portion 6 of the holding member 4 of the recording unit 1. The coupling member 9 also allows the pair of screws 10 to penetrate the pair of holes constituting the positioning sections 9*a* of the coupling member 9. The pair of screws 10 is thus threadably fitted in the pair of threads constituting the positioning sections 31*a* of the pair of L letterform members of the supporting members 31. The recording unit 1 is thus positioned and held in the supporting members 31.

The second embodiment of the image recording apparatus 11 thus positions and holds the nozzle forming surface 3*a* of the recording element 3 of the recording unit 1 above the conveying member 13 of the conveying mechanism 12 via a prescribed gap. This provides an image recording apparatus that can record high-quality images.

Even if for example, a curl or wrinkle occurs in the recording medium 14 placed on the conveying member 13 of the conveying mechanism 12 and conveyed below the nozzle forming surface 3*a*, the second embodiment of the image recording apparatus 11 can prevent the recording medium 14 from contacting the nozzle forming surface 3*a*. This avoids damaging the plurality of nozzles in the recording element 3.

In the second embodiment of the image recording apparatus 11, the recording unit 1 is mounted on and removed from the fixing member 8 by simple installation of the coupling member 9. This enables a reduction in apparatus manufacture costs and an improvement in maintainability.

The present invention is not limited to the above embodiments and variations. The components of the embodiments or variations may be appropriately modified or combined without departing from the disclosed spirit of the present invention. For example, in the above second embodiment of the recording unit according to the present invention, ink is supplied from the ink supply port 4*d* to the ink supply sections 2-1 to 2-4 through the ink path 4*e*, formed in the holding member 4.

The recording unit according to the present invention is not limited to this. The ink path 4*e* may be reformed into an ink supply port 2*a* similar to that in the first embodiment of the recording unit according to the present invention so that ink can be supplied directly to the ink supply sections 2-1 to 2-4.

It is also possible to remove some of the components of the recording unit or image recording apparatus according to the present invention, as required.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A recording unit for spouting ink to a recording medium which is conveyed by a conveying mechanism in a recording medium conveying direction, the recording unit comprising:

a recording element which has a nozzle forming surface in which a plurality of nozzles to spout the ink are formed;

a holding member which holds the recording element on a first surface of the holding member so that the nozzle forming surface opposes the conveying mechanism; and heat radiation fins which radiate heat generated by the recording element and which are provided on a second surface of the holding member, wherein the second surface of the holding member on which the heat radiation fins are provided is farther upstream in the recording medium conveying direction than the first surface of the holding member on which the holding member holds the recording element;

wherein portions of the heat radiation fins extend beyond the nozzle forming surface of the recording element toward the conveying mechanism, and the extended portions of the heat radiation fins guide the recording medium to the conveying mechanism.

2. The recording unit according to claim 1, wherein the second surface of the holding member on which the heat radiation fins are provided is opposite to the first surface of the holding member on which the holding member holds the recording element.

3. The recording unit according to claim 2, wherein the heat radiation fins are formed integrally with the holding member.

4. The recording unit according to claim 3, wherein the heat radiation fins extend in a direction substantially parallel to a direction in which the ink is spouted from the nozzles.

5. The recording unit according to claim 1, wherein the heat radiation fins are formed integrally with the holding member.

6. The recording unit according to claim 5, wherein the heat radiation fins extend in a direction substantially parallel to a direction in which the ink is spouted from the nozzles.

7. The recording unit according to claim 1, further comprising:

a recording element drive section which drives the recording element; and an ink supply section to supply the ink to the recording element;

wherein the holding member holds the recording element drive section, the ink supply section, and the recording element on the first surface of the holding member that is opposite to the second surface of the holding member on which the heat radiation fins are provided.

8. The recording unit according to claim 1, further comprising recording element support members which support the nozzle forming surface above lower tips of the extended portions of the heat radiation fins.

9. The recording unit according to claim 1, wherein the holding member comprises a positioning section to position the holding member.

10. An image recording apparatus comprising:

(i) a conveying mechanism having a conveying member on which a recording medium is placed for conveyance;

(ii) a recording unit for spouting ink to the recording medium which is conveyed by the conveying mechanism in a recording medium conveying direction, the recording unit comprising:

a recording element which has a nozzle forming surface in which a plurality of nozzles to spout the ink are formed;

a holding member which holds the recording element on a first surface of the holding member so that the nozzle forming surface opposes the conveying mechanism; and heat radiation fins which radiate heat generated by the recording element and which are provided on a second surface of the holding member, wherein the second surface of the holding member on which the heat radiation fins are provided is farther upstream in the recording medium conveying direction than the first surface of the holding member on which the holding member holds the recording element;

wherein portions of the heat radiation fins extend beyond the nozzle forming surface of the recording element toward the conveying mechanism, and the extended portions of the heat radiation fins guide the recording medium to the conveying mechanism; and (iii) a fixing member which fixes the holding member of the recording unit substantially perpendicularly to a conveying surface of the conveying member.

11. The image recording apparatus according to claim 10, wherein each of the holding member and the fixing member includes a first positioning section, and the fixing member and the holding member are positioned with respect to each other by using the first positioning section of the fixing member and the first positioning section of the holding member.

12. The image recording apparatus according to claim 11, further comprising a coupling member including second positioning sections;

wherein each of the fixing member and the holding member further includes a second positioning section;

wherein the coupling member couples the fixing member and the holding member to each other by coupling one of the second positioning sections of the coupling member with the second positioning section of the fixing member and by coupling another of the second positioning sections of the coupling member with the second positioning section of the holding member, after the fixing member and the holding member are positioned with respect to each other using the first positioning sections.

13. The image recording apparatus according to claim 12, wherein each of the positioning sections of the fixing member, the holding member, and the coupling member comprises one of (i) a pin and (ii) a hole into which a pin is fitted.

14. The image recording apparatus according to claim 13, wherein the coupling member has at least one hole formed therein, and a screw is inserted through the hole and tightened in the fixing member to position and hold the holding member on the fixing member.

15. The image recording apparatus according to claim 10, wherein the fixing member comprises a supporting member which supports the holding member.

16. The image recording apparatus according to claim 15, wherein the supporting member comprises a pair of substantially L-shaped members.

17. The image recording apparatus according to claim 15, wherein the supporting member comprises a support base level which slidingly contacts a base level of the holding member.

18. The image recording apparatus according to claim 17, wherein the supporting member comprises an elastic member which presses the holding member toward the support base level so that the holding member touches the support base level.

19. The image recording apparatus according to claim 18, wherein the elastic member comprises a leaf spring.

* * * * *